US005247753A

United States Patent [19]

Yang

[11] Patent Number: 5,247,753

[45] Date of Patent: Sep. 28, 1993

[54] DOLL APPARATUS WITH AN AC MOTOR CONNECTED WITH A STRING-SET

[76] Inventor: Steve Yang, 5FL.-18, No. 3, Tien Mou W. Rd., Shi-Lin, Taipei, Taiwan

[21] Appl. No.: 727,439

[22] Filed: Jul. 9, 1991

[51] Int. Cl.[5] ..... G09F 19/08

[52] U.S. Cl. ..... 40/414; 40/418; 446/354

[58] Field of Search ..... 40/414, 417, 418, 419, 40/420; 318/774, 778, 786, 787; 446/354, 352, 353, 297, 298; 310/83, 89; 362/806; 74/48

[56] References Cited

U.S. PATENT DOCUMENTS

| | | | |
|---|---|---|---|
| 766,878 | 8/1904 | Foster | 74/48 X |
| 2,101,989 | 12/1937 | Ferbend | 310/83 X |
| 2,724,926 | 11/1955 | Fisher | 40/417 X |
| 2,814,766 | 11/1957 | Dreier et al. | 310/89 X |
| 3,448,306 | 6/1969 | Murray | 310/83 |
| 3,872,334 | 3/1975 | Loubier | 310/83 X |
| 4,682,079 | 7/1987 | Sanders et al. | 362/806 X |
| 4,803,796 | 2/1989 | Ottinger | 40/414 |
| 4,864,879 | 9/1989 | Hou | 446/352 X |
| 4,867,730 | 9/1989 | Lee | 446/353 |
| 4,869,703 | 9/1989 | Ong S.T. | 40/414 X |
| 4,980,608 | 12/1990 | Morrison | 362/806 X |
| 5,121,646 | 6/1992 | Cho | 40/414 X |

*Primary Examiner*—Kenneth J. Dorner
*Assistant Examiner*—J. Bonifanti
*Attorney, Agent, or Firm*—Lowe, Price, LeBlanc & Becker

[57] ABSTRACT

This invention is related to an AC motor with larger torque which is adapted to plug into a lamp socket of a string-set of series connected decorative lamps directly so as to utilize the output of the AC motor to drive the transmission means of the doll apparatus to do a variety of action just in low current of the string-set. Furthermore, utilizing this doll apparatus, we can design an ornamental Santa Claus, a tree top angel, or a flying angel saving as the ornament of X'mas tree with the string-set.

2 Claims, 12 Drawing Sheets

DOLL APPARATUS WITH AN AC MOTOR CONNECTED WITH A STRING-SET

FIELD OF THE INVENTION

The present invention is generally related to a doll apparatus with an AC motor able to be directly connected with a string-set, especially a X'mas string-set of series connected decorative lamps. It mainly comprises an AC motor with larger torque to drive the transmission means of doll apparatus such that the string-set is more particular.

BACKGROUND OF THE INVENTION

A conventional string-set of series connected decorative lamps is composed of a 120 V AC power plug and multiple small sockets able to accept bulbs. As previously stated, the typical string of X'mas tree light is usually found to be 35 or 50 lights per string. All of the light bulbs are connected in series to a 120 V AC supply. Although a conventional string-set can also serve as an decorative item, its monotonous variation in lighting seems not attractive enough.

Referring to U.S. Pat. No. 4,682,079 granted to Sanders et al, in which the new design of string-set provides a renovated circuit which can transfer AC power source to DC source for a DC motor to drive some small-size acting decorative means. The major defect of this patent is to use too many electronic elements which raise production cost and thereby production defect. Apart from this, an operating DC motor is very noisy and has higher percentage of defectives than those for an AC motor.

As for another example, U.S. Pat. No. 4,980,608 granted to Morrison, which involves a small AC motor connected with strings in series so as to rotate a small suspending ornament. In this patent, the major method applied is to design an AC motor which impedance could be the same as the light bulb and therefore interchangeable in the light string. The major defect of this patent is that the torque of the motor is excessively small (about 0.070 kgw/cm). The output torque of the motor is limited and only small suspending ornament can be rotated, because the current through the bulbs is in the range of 0.120 to 0.210 amperes and the impedance of the AC motor is equivalent to the light bulb. If it is desired a larger transmission means of a doll to be driven, this motor will fail.

SUMMARY OF THE INVENTION

It is, therefore, an object of the present invention to provide a doll apparatus able to be directly connected with a small socket of a string-set and to utilize a particular AC motor mounted in the apparatus which can drive the transmission means of the doll such that the head, hands or wings of the doll can be active.

Another object of the present invention is to provide an AC motor able to match the string-set and output a larger torque (about 0.800 kgw/cm) to drive the doll to action.

Other objects and functions of the present invention are described as follows referring to more preferable embodiment.

DESCRIPTION OF THE PREFERRED EMBODIMENT

Figure 1:
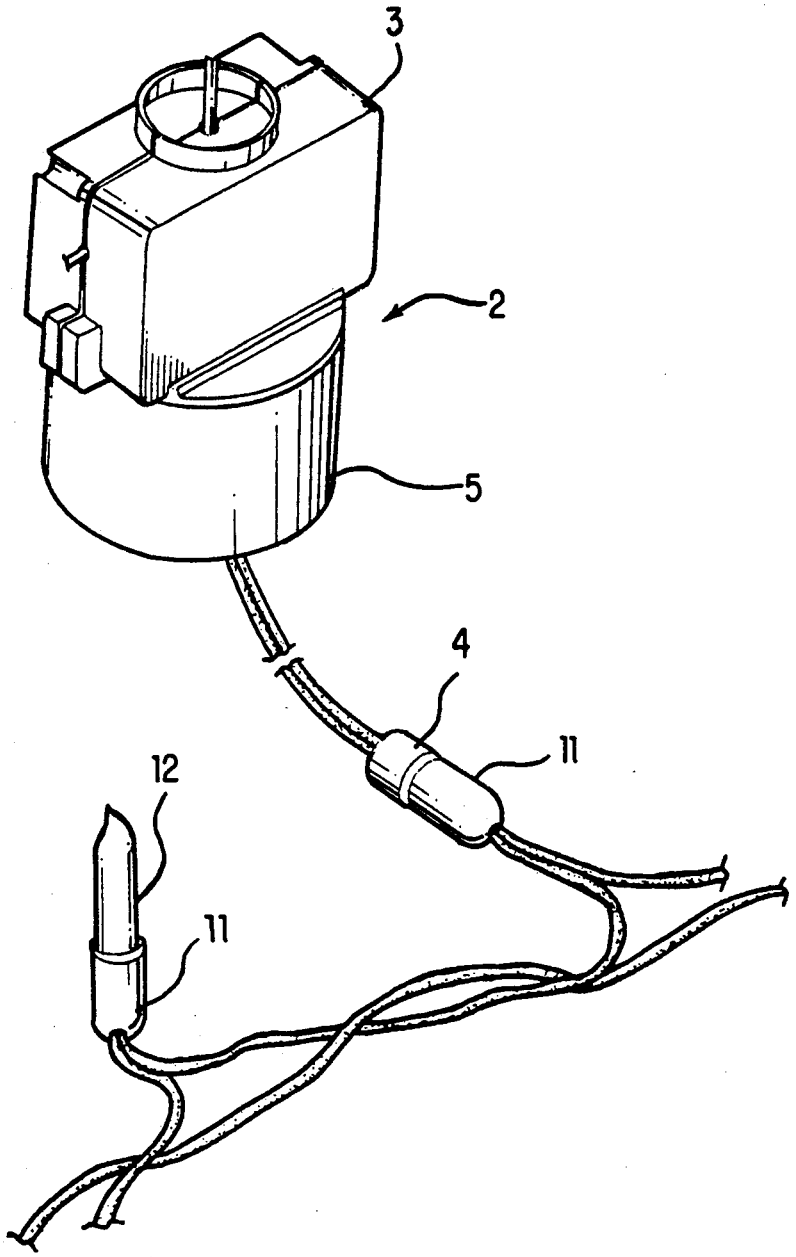
FIG. 1 illustrates a schematic drawing showing the connection of the doll apparatus of the present invention.

Referring to FIG. 1, the present invention provides a doll apparatus with an AC motor. It can be connected with a string-set of series connected decorative lamps by means of a plug socket 11. The doll apparatus 2 comprises a transmission means 3, an AC motor set 5 and a plug 4 which is able to be inserted in the socket 11 of the string-set so as to supply energy to said AC motor set. The string-set has a electrical power plug which can receive 120 V power source then providing the voltage to all lamps 12 connected in series by inserting into the plug sockets 11 and the AC motor set 5.

The transmission means 3 comprises many transmitting elements which can transfer the output torque of the AC motor set 5 to drive the head, the hands or the wings of the doll (not showed in the drawing). This indicates that the output energy of the AC motor set should be large enough to drive the doll. Therefore, the small motor having a predetermined impedance equivalent to one of lamps mentioned in Morrison Patent can not supply enough torque to drive the transmission means. In this condition, the present invention provides an AC motor set 5 with renovated structure.

When considering the structure of AC motor set 5, we shall review the simple knowledge of electrical circuit. The impedance of an ordinary motor can be formulated as:

$$Z=jL+R$$

Referring to the above formula, "j" stands for complex number, "L" stands for inductance and "R" stands for resistance meaning real number. The current consumed by the resistance is transferred into real power and the current consumed by the inductance is transferred into imaginary power. The output power can be formulated as:

$$P = Vl = Rl^2$$

Referring to the above formula, "V" stands for voltages and "l" stands for current. As a result, under the condition of equal amperes of current, output power of the motor relates to the value of resistance, and therefore, resistance of the motor can help raise power. The strength of resistance relates to the diameter of coil winding. In other words, the output power can be increased when the diameter of the coil winding of the motor is increased.

In addition, the output torque of the motor can be increased in another way. Whereas, output force "f" relates to magnetic flux "$\phi$" as $$f = C \times \phi 1 \times \phi 2 / d2$$

Thus, in order to obtain higher output, make the magnetic flux of the coil and the magnetic flux of the center magnet equal. Simply speaking, the magnet should match the coil. In view of the magnetic flux generated by the coil as:

$$\phi = 1 \times N$$

Referring to the above formula, "N" stands for turns of coil. This means that increased turns of the coil can also raise efficiency of the output of the motor.

Referring to a generally designed string-set composed of either 30 or 50 bulbs, every bulb indicates, after undergoing a test, that 0.120 to 0.210 amperes are demanded. For this reason, we can desire for the coil of the motor so as to increase the output torque of the AC motor.

Figure 2:
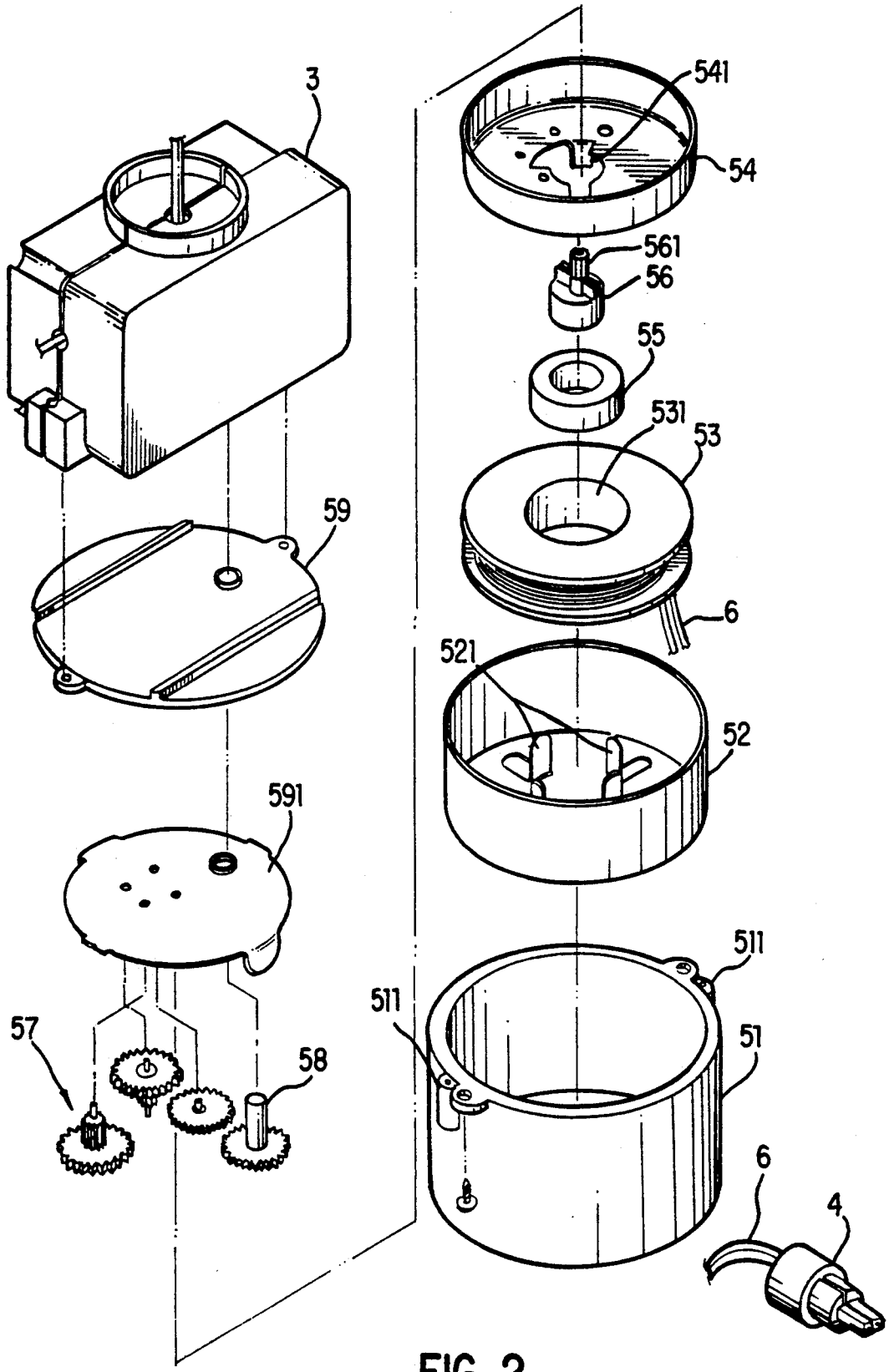
FIG. 2 illustrates a exploded drawing of the doll apparatus of the present invention.
Figure 3:
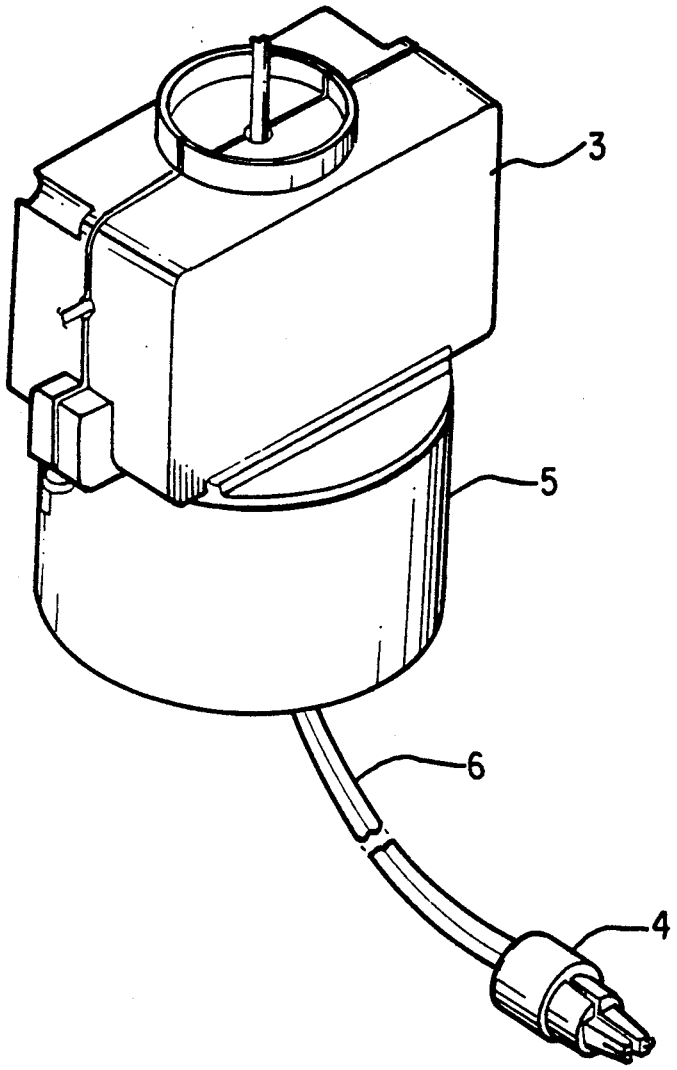
FIG. 3 illustrates an assembly drawing of the doll apparatus of the present invention.

Referring to FIG. 2 which shows the exploded perspective view of the doll apparatus 2 of the present invention, in which multiple parts of the AC motor set 5 is mounted in a metal case 52 covered with an insulated case 51. There is a coil 53 fixed in the metal case 52 to be composed of 600 to 850 turns of thicker winding. A wire 6 extends out from the metal case and the insulated case is connected with the plug 4 able to be inserted in the plug socket 11 of the string-set. At the bottom of the metal case 52, several upwardly protruding plates 521 extending to the center hole 531 of the coil 53 are set; the protruding plates 521 and the plates 541 extending downwardly from the upper metal case 54 form six poles, also known as the outer stator of the motor, which make the coil 53 drive a rotary magnet 55 set in the center hole 531 after the coil is supplied with power source by the wire 6. The magnet 55 is a permanent magnet rotor, from the middle of which a rotor spindle 56 extends upwardly and a rotor pinion 561 engages with a reducing gear set 57. As a result, the number of the revolution of the output rotor spindle 58 set at the end of the reducing gear set can be properly regulated, and thus the rotary spindle 58 for the output power mounted at the end of the reducing gear set can be well accommodated until the output revolution is reasonably demanded for the transmission means 3 mounted on the guard of the upper metal case 591 and the guard of the upper case 59 so that the transmission means 3 can implement multiple-directional movement and drive the doll therefor.

Figure 4:
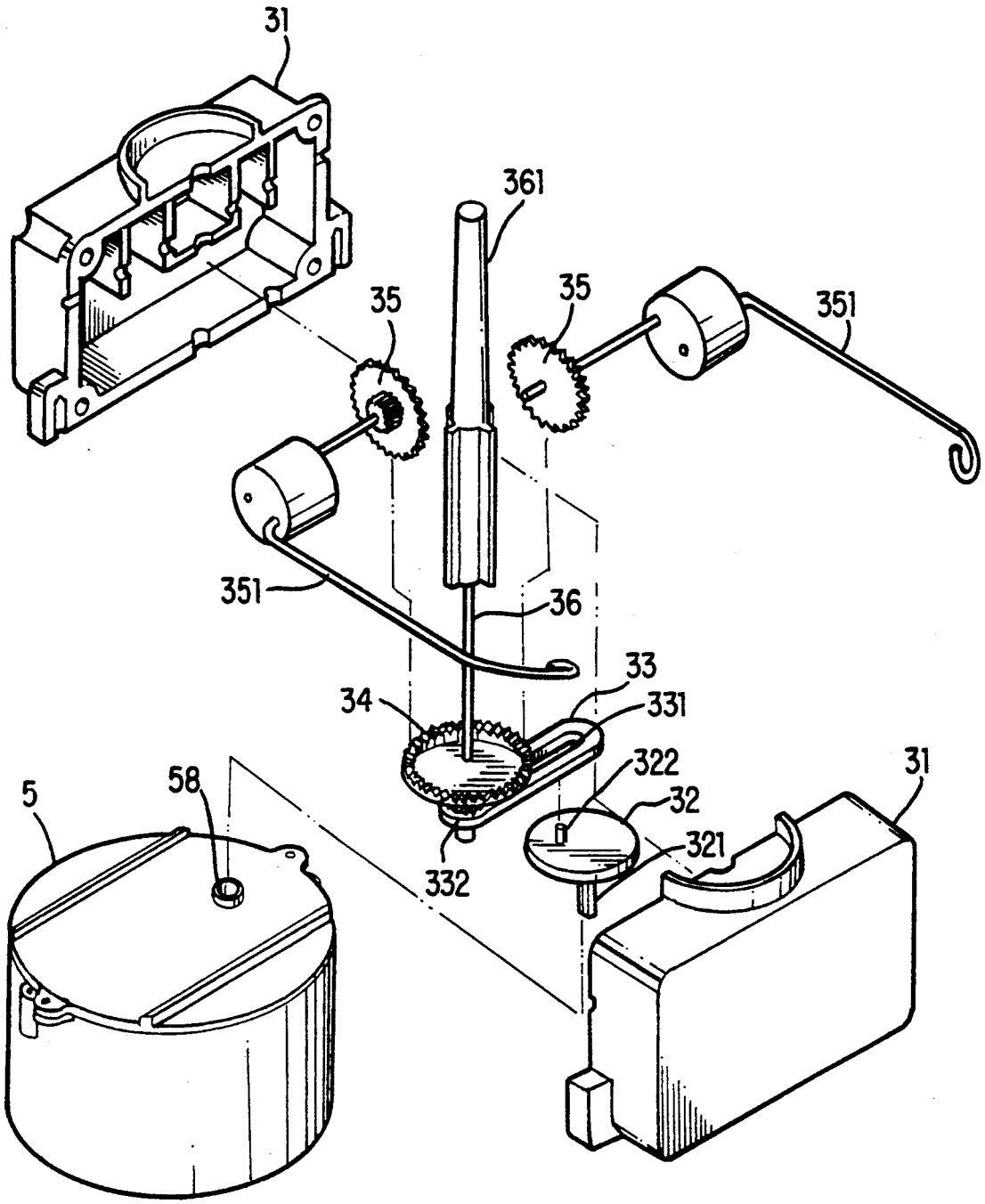
FIG. 4 illustrates a detail drawing of the transmission means of the present invention.
Figure 5:
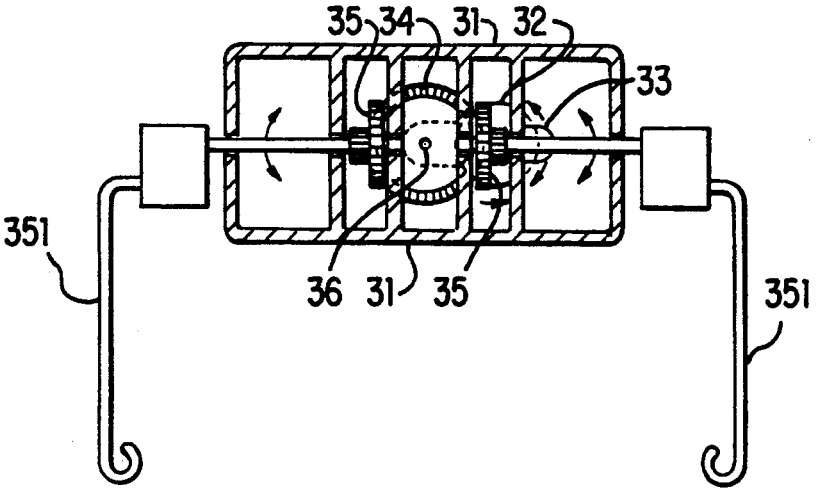
FIG. 5 illustrates a sectional drawing of the transmission means referring to FIG. 4 of the present invention.

Referring to FIG. 4 and FIG. 5, which indicate one embodiment of the transmission means of the present invention, the design of the transmission means 3 provides a device to drive the doll move its head and hands. In the bilaterally symmetric case 31 is fixed transmitting elements which comprise an eccentric wheel 32, a link 33 with a slide way 331, a crown gear 34 and a pair of spur gear 35. A rotary rod 321 downwardly protrudes from the center of the eccentric wheel 32 and extends to be connected with the power output rotary spindle 58 of the AC motor set 5 so that the torque of the AC motor set 5 can be inputted to the transmission means. A protrusion 322 is fixed at the upper side of the eccentric wheel 32, which extends to the slide way 331 of the link 33 so that the eccentric wheel can drive the link 33 with the slide way and makes the link swing in succession with the fixed end as a center, when it is driven by AC motor set 5 and rotates. Furthermore, the middle axle 36 actually passes through the center of the crown gear 34 and the fixed end 332 of the link 33 such that the link 33 with the slide way can make the crown wheel 34 move reciprocatingly at a certain degree through the middle axle 36 when it is swinging reciprocatively. As a result, the spur gears 35 which engages with the crown gear 34 perpendically will generate reciprocating movement at a certain degree perpendically. The loop bar 361 extending out from the middle axle 36 is connected with the doll's head, and the long rods 351 separately extending out from the two spur gears 35 are connected with the hands of the doll respectively.

After the plug 4 extended from the AC motor set 5 plugs into the socket 11 of the string-set, the motor is supplied with power source from the string-set, and the doll mounted on the motor set begin to wave its hands and head. This design is characterized by its various change.

Figure 7:
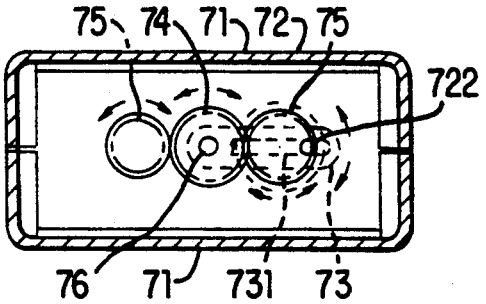
FIG. 7 illustrates a sectional drawing of the transmission means of the present invention referring to FIG. 6.
Figure 6:
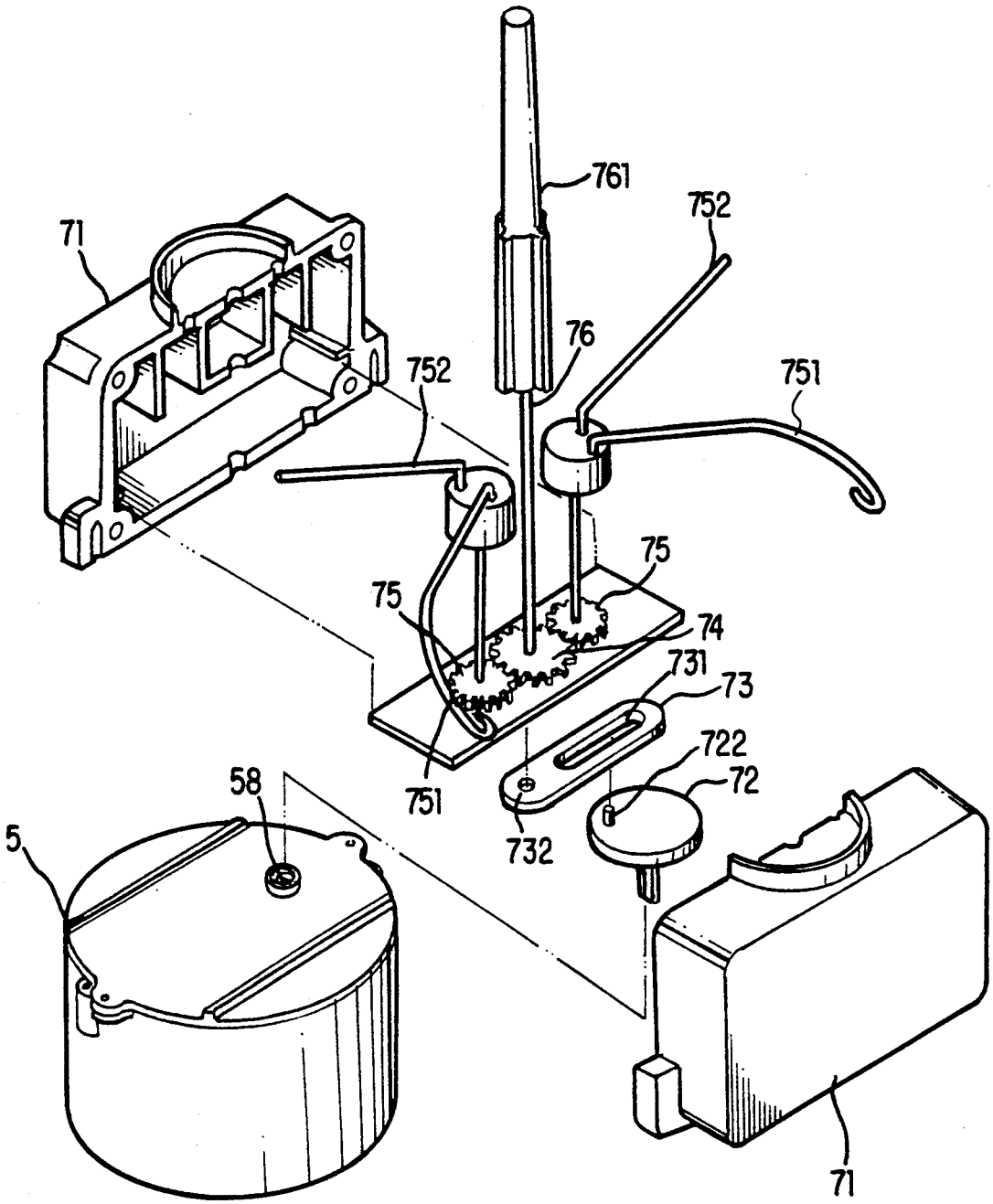
FIG. 6 illustrates a detail drawing of another transmission means of the present invention.

Furthermore, referring the FIG. 6 and FIG. 7, which show another embodiment of the transmission means of the present invention, the focus of the design is placed on the motion of the head, the hands and the wings of the doll. In bilaterally symmetric case 71 are fixed transmitting elements which comprises an eccentric wheel 72, a link with a slide way 731, a middle gear 74 and a pair of spur gears 75. The eccentric wheel 72, therefore, is connected with the slide way 731 of the link 73 and the AC motor set 5 in the same way as mentioned above. The middle axle 76 passes through the middle gear 74 and the fixed end 732 of the link 73. This is why, when the eccentric wheel 72 is driven by AC motor set 5, the eccentric wheel extends to the slide way 731 through the protrusion 722 of the eccentric wheel and rotates the middle axle at a reciprocative degree; as a result apart from the loop rod 761 extending out to the doll's head and the top place of the middle axle which is swinging, the two spur gears 75 engaging with the middle gear 74 horizontally move reciprocatively at a certain degree, and then the front and the rear long rods 751, 752 extending out from the spur gears activate the doll's wings and hands separately.

Figure 8:
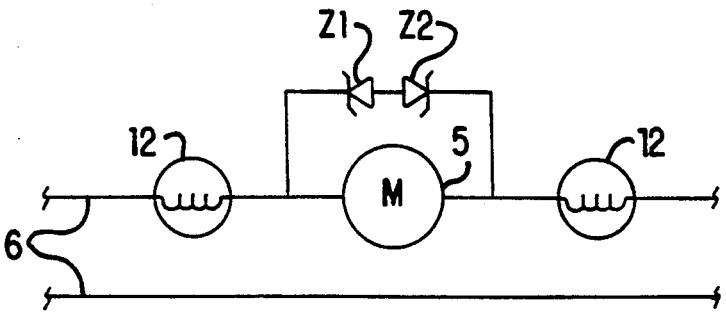
FIG. 8 illustrates the electrical schematic diagram connecting the string set and the motor of the present invention.

Referring to FIG. 8, where a circuit diagram is shown, the AC motor set 5 are mounted a pair of zener diodes Z1, Z2 connected each other in reverse and connected with the AC motor in parallel so as to control constant voltage of the AC motor set 5; this means that the diodes can serve as a diverter to sustain a constant quantity of current passing through the AC motor 5 and to release the excess current. All this is for keeping normal operation of the motor.

What's more important, the present invention provides an AC motor set fixed with a reducing gear set 57 of which "no back" device is mounted so as to stop reverse rotation when the circuit breaks off or is being linked with the power source. The "no back" device is thus similar to that involving in the patent of Morrison has been granted.

Figure 9:
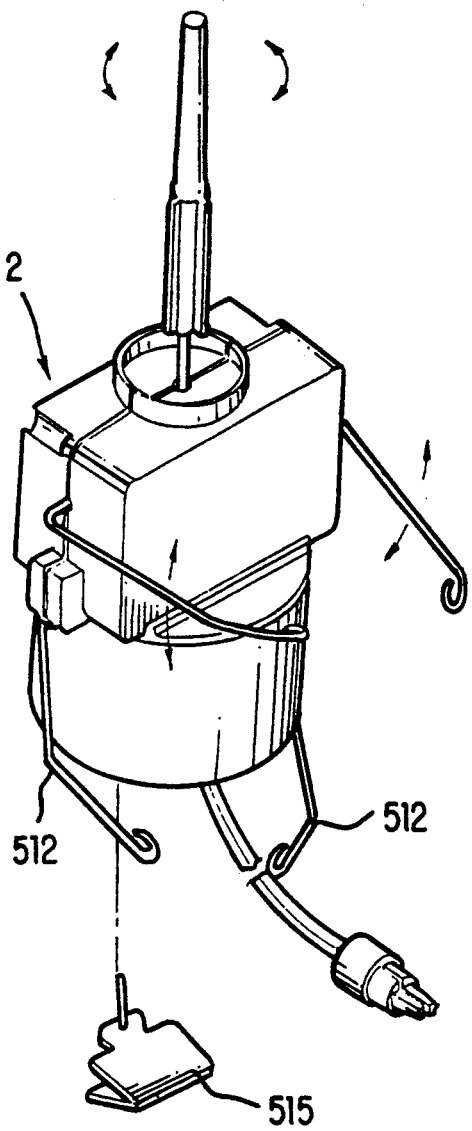
FIG. 9 illustrates one embodiment of the present invention.
Figure 10:
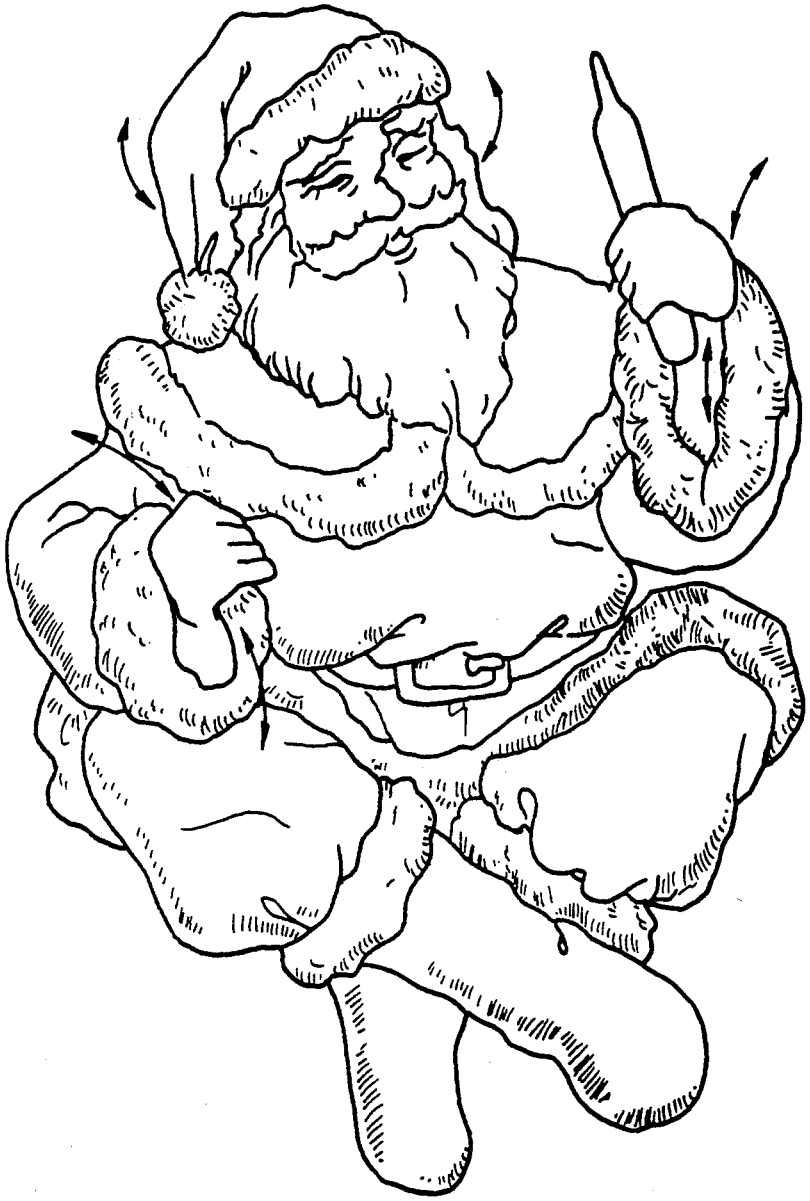
FIG. 10 is an ornamental Santa Claus according to the doll apparatus of FIG. 9.

The insulated case 51, showed in FIG. 2, has a pair of lugs 511 to connect with flexible rods. In FIG. 9, the lugs of the AC motor set 511 are connected with flexible rods 512 separately and the transmission means 3 is the same as the description of FIG. 4 and FIG. 5. The flexible rods 512 support the legs of an ornamental Santa Claus showed in FIG. 10. There is a clip 515 extended and connected at the bottom of the insulated case 51 to mount the ornament Santa Claus on the X'mas tree.

Figure 11:
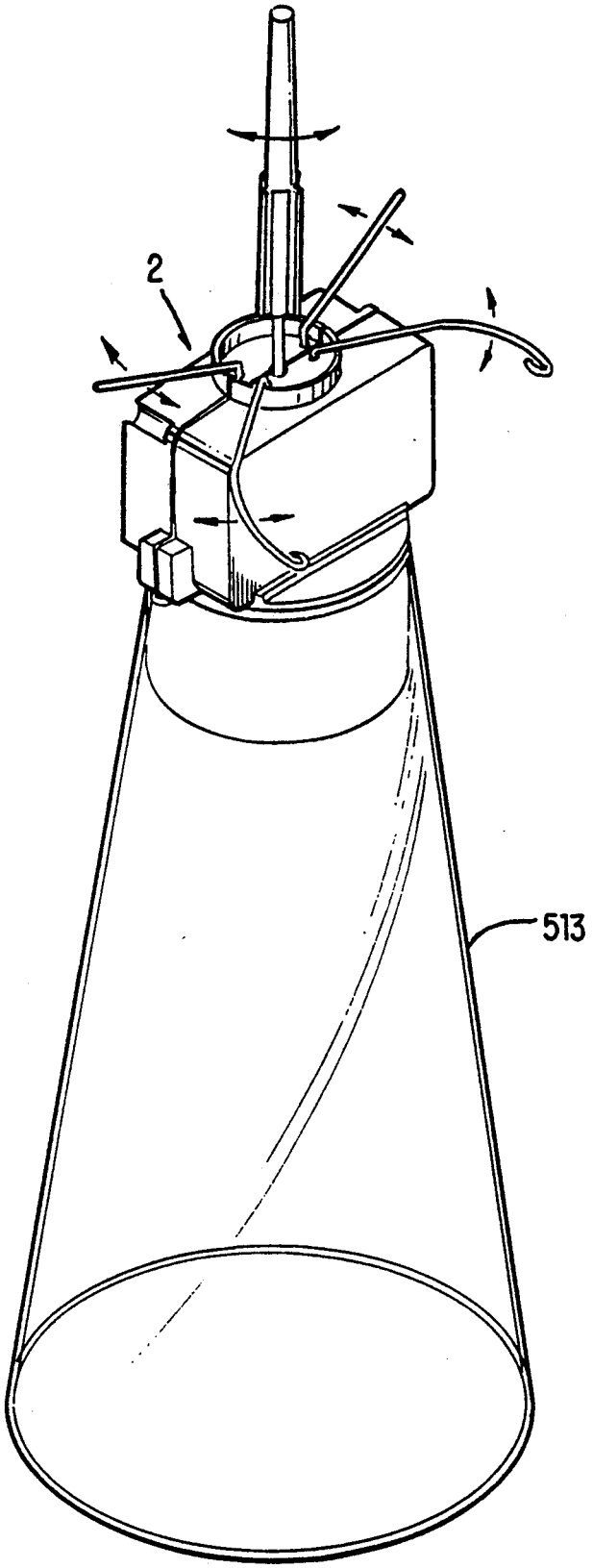
FIG. 11 illustrates another embodiment of the present invention.
Figure 12:
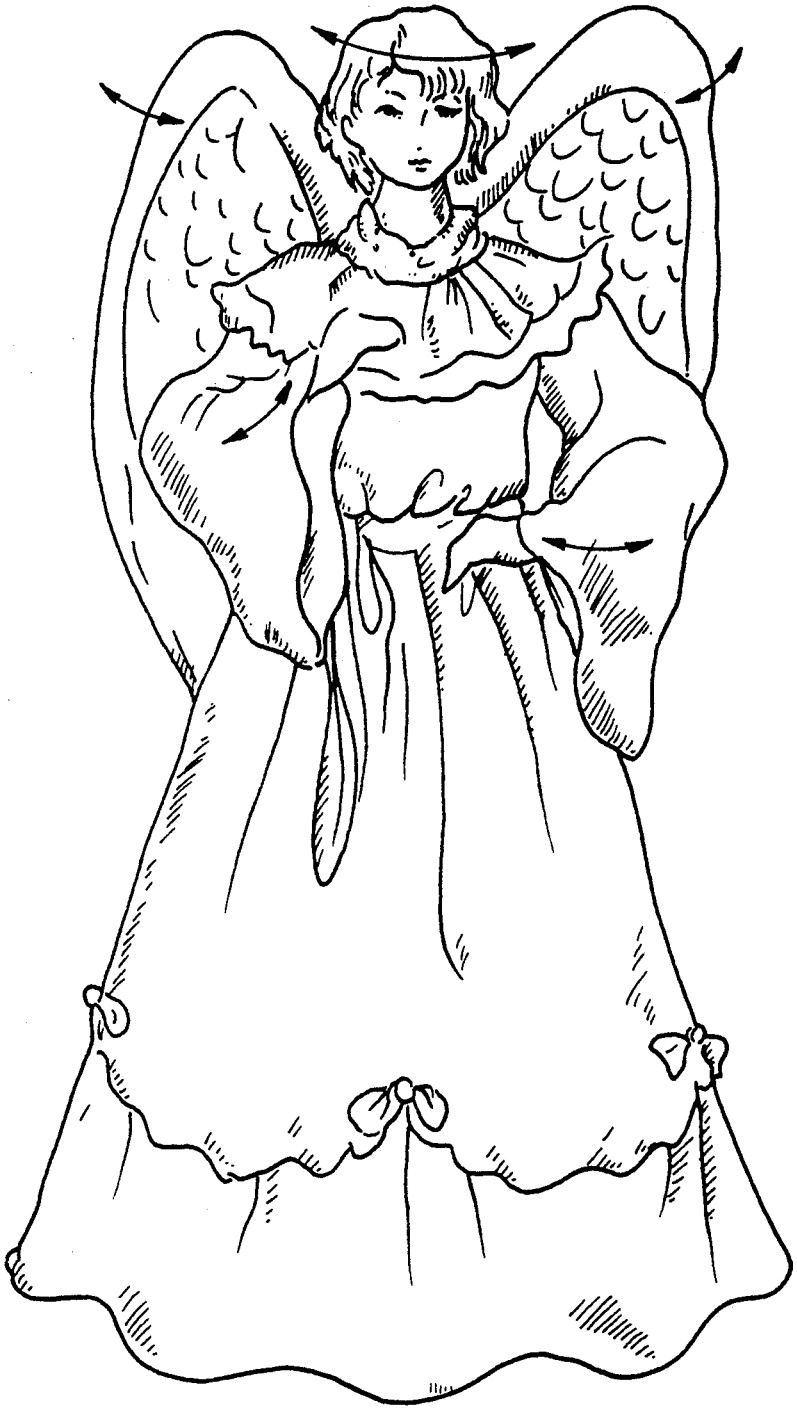
FIG. 12 is a tree top angel according to the doll apparatus of FIG. 11.

Referring to FIG. 11, the doll apparatus 2 of the present invention is connected with a PVC drum 513 for supporting a tree top angel showed in FIG. 12. In this embodiment, the transmission means 3 of the doll apparatus is the same as the description of FIG. 6 and FIG. 7 such that the head, the hands, and the wings of the angel can move. In this embodiment, the PVC drum 513 can cover the top of a X'mas tree for mounting the angel.

Figure 13:
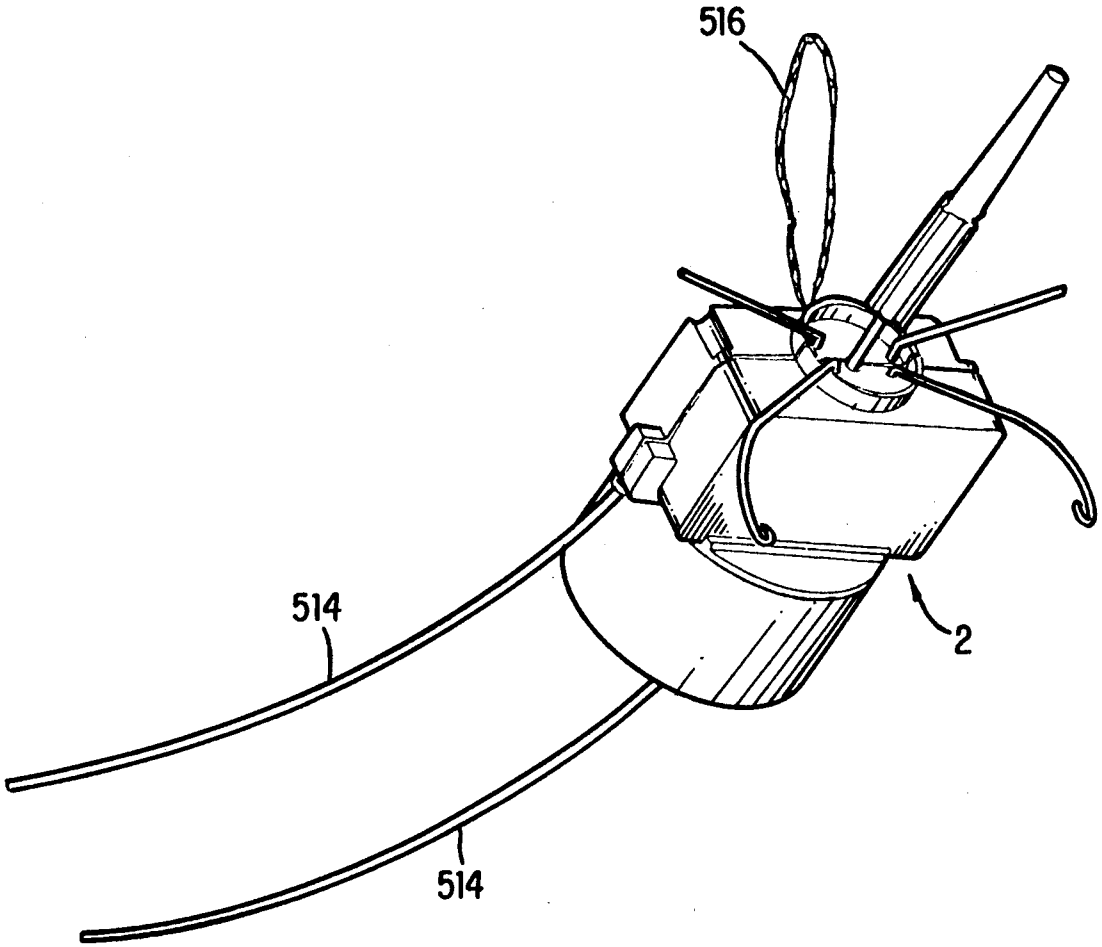
FIG. 13 illustrates the other embodiment of the present invention.
Figure 14:
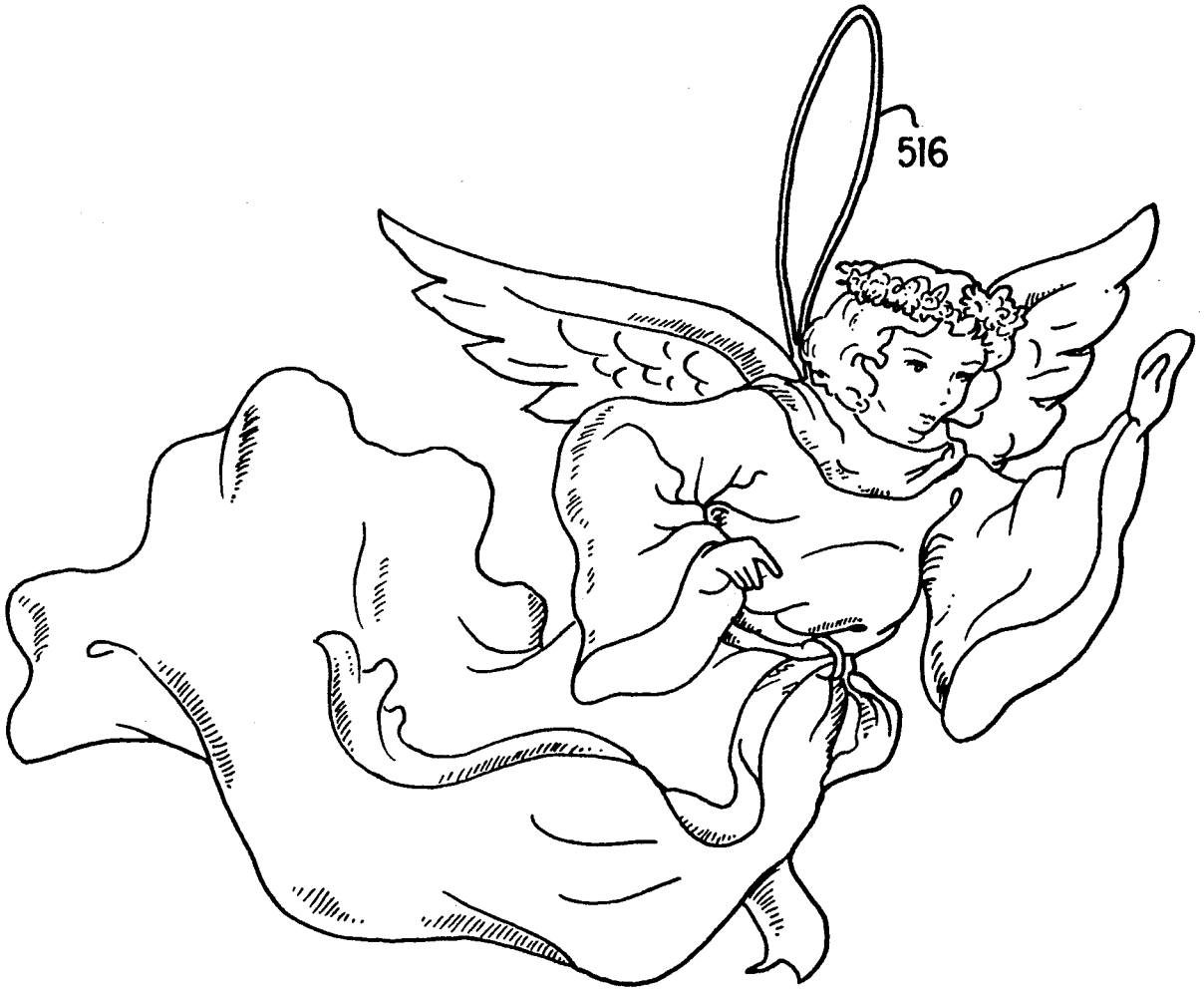
FIG. 14 is a flying angel according to the doll apparatus of FIG. 13.

FIG. 13 and FIG. 14 are another embodiment of the present invention, in which the doll apparatus 2 having the transmission means 3 as the description of FIG. 6 and FIG. 7 and the motor set 5 is connected with a loop 516 for hanging the flying angel doll showed in FIG. 14 on a X'mas tree. The lugs 511 of the insulated case 51 is connected with flexible long rods 514 separately for supporting the flying angel in FIG. 14.

What is claimed is:

1. In a decorative string of lamps including a plurality of miniature sockets and a flexible electrical conductor interconnecting said sockets and a power plug connected to said conductor and adapted to be coupled to a source of alternating current, each socket normally receiving a lamp bulb, the improvement comprising:

at least one motorized doll coupled to at least one of sockets comprising a doll body, an alternating current motor coupled thereto, having a coil with a predetermined number of turns surrounding a central axial opening, said coil connected to an electric conductor which in turn terminates in a socket plug normally received in one of said miniature lamp sockets, a metal housing surrounding said coil on the sides, top and bottom and an insulator means surrounding said housing; mutually spaced metal tabs extending from the top and bottom of said housing into the central opening of said coil to form a stationary outer stator; a permanent magnetic rotor disposed within the outer stator, and a rotary spindle rotably mounted within said rotor so that when said coil is coupled to a source of alternating current said spindle will rotate, reducing gear means coupled to said spindle for translating the rotation thereof and transmission means mounted on said housing and coupled to said gear means and to said doll body for driving said doll body responsive to said spindle rotation, said transmission means comprising a link having a slideway therein, eccentric gear means drivingly coupled to said spindle and having a protrusion fixed on the outer portion thereof extending into the slideway of said link, an axle fixed to said link at an end thereof removed from the protrusion, and gear means including an inner gear and a plurality of spur gears coupled thereto, coupled to said axle for driving said doll body responsive to rotation of said link about the fixed protrusion, which in turn rotates responsive to rotation of said spindle.

2. The motorized doll of claim 1 wherein the motorized doll further includes Zener diode means coupled between said flexible electrical conductor and said motor for ensuring a constant voltage to said alternating current motor and for diverting excess current so as to ensure normal rotation of said motor when coupled to said source of alternating current at a predetermined rate.

* * * * *